US008025382B2

(12) United States Patent
Tajima

(10) Patent No.: US 8,025,382 B2
(45) Date of Patent: Sep. 27, 2011

(54) INK JET HEAD CARTRIDGE, PRINT HEAD, INK CONTAINER, AND METHOD FOR MANUFACTURING INK JET HEAD CARTRIDGE

(75) Inventor: Hiroki Tajima, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 920 days.

(21) Appl. No.: 11/951,454

(22) Filed: Dec. 6, 2007

(65) Prior Publication Data

US 2008/0136880 A1 Jun. 12, 2008

(30) Foreign Application Priority Data

Dec. 6, 2006 (JP) ..... 2006-329736

(51) Int. Cl.
*B41J 2/175* (2006.01)
*B41J 2/15* (2006.01)

(52) U.S. Cl. ..... 347/87; 347/40

(58) Field of Classification Search ..... 347/61, 347/65, 66, 85, 87
See application file for complete search history.

(56) References Cited

U.S. PATENT DOCUMENTS

| | | | | |
|---|---|---|---|---|
| 5,682,187 | A * | 10/1997 | Watanabe et al. | 347/45 |
| 5,701,995 | A | 12/1997 | Higuma et al. | 206/205 |
| 5,742,309 | A | 4/1998 | Tajima et al. | 347/86 |
| 5,886,721 | A * | 3/1999 | Fujii et al. | 347/87 |
| 6,045,218 | A | 4/2000 | Tajima et al. | 347/86 |
| 6,179,415 | B1 | 1/2001 | Okazaki et al. | 347/86 |
| 6,179,416 | B1 | 1/2001 | Ikeda et al. | 347/86 |
| 6,250,752 | B1 | 6/2001 | Tajima et al. | 347/92 |
| 6,286,944 | B1 | 9/2001 | Shimizu et al. | 347/86 |
| 6,431,681 | B2 | 8/2002 | Hatasa et al. | 347/19 |
| 6,513,920 | B1 * | 2/2003 | Deshmukh et al. | 347/92 |
| 6,631,982 | B2 | 10/2003 | Sasaki et al. | 347/85 |
| 6,805,437 | B2 | 10/2004 | Yamanaka et al. | 347/92 |
| 6,851,795 | B2 | 2/2005 | Watanabe et al. | 347/50 |
| 6,945,643 | B2 | 9/2005 | Tajima et al. | 347/87 |
| 7,044,588 | B2 | 5/2006 | Tajima et al. | 347/85 |
| 7,273,275 | B2 * | 9/2007 | Buchanan et al. | 347/87 |
| 2008/0136870 | A1 | 6/2008 | Miyazaki | 347/47 |

FOREIGN PATENT DOCUMENTS

JP 2005-342994 12/2005

* cited by examiner

*Primary Examiner* — Anh T. N. Vo
(74) *Attorney, Agent, or Firm* — Fitzpatrick, Cella, Harper & Scinto

(57) ABSTRACT

Reliable ink jet print head, ink jet head cartridge, ink container, and the manufacture method thereof are provided. Specifically, an ink supply opening of an ink container includes a beam member crossing the ink supply opening. The beam member is shaped so that filler material included therein is oriented in a direction along which the beam member extends. By providing the beam member in the ink supply opening of the ink container, the deformation of the ink container due to a temperature change is prevented by the beam member having a smaller linear expansion coefficient that extends in a direction orthogonal to the nozzle arrangement direction. Thus, a more reliable ink jet print head can be provided. In addition, higher strength can be achieved in a direction orthogonal to the nozzle arrangement direction of the ink container.

10 Claims, 9 Drawing Sheets

INK JET HEAD CARTRIDGE, PRINT HEAD, INK CONTAINER, AND METHOD FOR MANUFACTURING INK JET HEAD CARTRIDGE

BACKGROUND OF THE INVENTION

1. Field of the Invention

The present invention relates to an ink jet head cartridge in which a print head and an ink container for supplying ink to the print head are integrated, a print head, and an ink container. In particular, the present invention relates to stress between an ink container and a printing element substrate caused due to a temperature change. The present invention also relates to a method for manufacturing the ink jet head cartridge.

2. Description of the Related Art

An ink jet printing apparatus is a printing apparatus based on a so-called non-impact printing method and is characterized in that this apparatus causes very small noise during a printing operation. This apparatus also can be used to perform a high-speed printing to various printing media. By the above characteristics, the ink jet printing apparatus has been widely used as an apparatus for providing a printing mechanism for a printer, a copier, a facsimile, a word processor or the like.

Print head provided in the ink jet printing apparatus as described above include the one that uses an electrothermal conversion element having a heat generation resistance member to heat ink to use a film boiling to eject ink droplets. An ink jet print head using the electrothermal conversion element as described above is structured so that an electrothermal conversion element is provided in a printing liquid chamber. When a printing operation is performed, an electric pulse is supplied to the electrothermal conversion element based on a printing signal to generate heat to apply thermal energy to ink. Then, a bubble pressure of bubble formation (boiling) in ink due to a phase change of printing liquid is used to eject ink droplets through minute ejection openings. In this manner, ink droplets are ejected from a print head to print ink on a printing medium.

The ink jet print head ejects ink in a relatively small size and requires liquid droplets to be adhered to a paper with a high accuracy. Thus, when a printing element substrate is deformed, a significant influence is caused on the performance of the printing apparatus. Thus, such deformation is desirably minimized.

On the other hand, ink jet print heads in recent years tend to have been required to have a smaller size and a low profile. In order to satisfy such a demand, a print head integrated with an ink container for storing ink has been suggested.

This integrated ink jet head cartridge type ink jet print head has an ink container that is generally manufactured by molding resin because of its easy manufacture and cost for example. By using resin molding, a complicated shape can be manufactured. Furthermore, a part of this ink container has a joint area having a flat surface with a high degree of accuracy so that this part can be directly joined with a printing element substrate. This joint area also can use resin molding to secure a flat surface with a high degree of accuracy.

By adhering a printing element substrate to this joint area by adhesive agent for example, an ink jet print head can be assembled with a simple structure. Furthermore, an ink jet print head with a low cost and a high performance can be manufactured in the manner as described above.

Japanese Patent Laid-Open No. 2005-342994 describes an example of this integrated-type ink jet head cartridge and describes the structure of the ink jet head cartridge and the manufacture method thereof. According to Japanese Patent Laid-Open No. 2005-342994, a printing element substrate is adhered and fixed to an ink container by adhesive agent or the like. FIGS. 9A and 9B show an example of an ink jet head cartridge to which a printing element substrate is adhered.

By the way, the conventional ink jet head cartridge as shown in FIGS. 9A and 9B is structured so that container-side ink supply opening H5201, H5202, and H5203 are arranged in parallel with one another in a direction along which nozzles are arranged. A substrate-side ink supply opening H5102*a*, H5102*b*, and H5102*c* have communication with the container-side ink supply openings H5201, H5202, and H5203. The substrate-side ink supply openings H5102*a*, H5102*b*, and H5102*c* are also arranged in parallel with one another in a direction along which nozzles are arranged. However, in this case, a problem is caused in which the ink container H5501 manufactured by resin as described above and the joint area of the printing element substrate H5101 manufactured by silicon connect with each other and cause the deformation of the printing element substrate H5101. Specifically, when the ink container H5501 is manufactured by die forming, resin flows in a nozzle arrangement direction among the ink supply openings H5201, H5202, and H5203 in the side of ink container H5501. Thus, after the molding, glass filler included in resin tends to be in a direction in parallel with the nozzle arrangement direction. In this case, a linear expansion coefficient of resin in a direction orthogonal to a direction along which glass filler is oriented is higher than that of resin in a direction along which the glass filler is oriented. On the other hand, the printing element substrate H5101 formed by silicon is adhered to the ink container H5501. Then, silicon and resin basically have different linear expansion coefficients and a direction orthogonal to a direction along which glass filler is included in resin has a relatively high linear expansion coefficient as described above. This causes a large difference in the linear expansion coefficient between silicon and resin at the joint area of the ink container H5501 and the printing element substrate H5101. Thus, when environmental temperature of the ink jet head cartridge changes, the large difference in the linear expansion coefficient causes the deformation of the printing element substrate and the ink container. As a consequence, an influence is caused on the ink ejecting performance of the print head.

For example, the ink jet head cartridge having the structure and material characteristic as described above must be maintained at a high temperature in order to cure thermoset-type adhesive agent in an assembly step. This step heats the ink jet head cartridge to a temperature of 100 deg C. or more. Thus, adhesive agent cured at 100 deg C. causes a difference in the linear expansion coefficient between silicon and resin, and thus causes stress between the materials due to the shrinkage for Δ75 deg C. Furthermore, when a physical distribution status is considered to consider a low temperature environment of −30 deg C., the stress between the materials for Δ55 deg C. is caused additionally. The larger the difference in the linear expansion coefficient is, the higher the stress caused between materials is. Thus, a risk is caused where the product may deform due to the residual stress due to the difference in the linear expansion coefficient.

In particular, when an ink jet head cartridge can eject a plurality of colors of ink (e.g., when a printing element substrate has an integrated structure of three colors of C, M, and Y), the respective ink supply openings for supplying the respective colors of ink are arranged in parallel with the nozzle arrangement direction. The characters C, M, and Y represent the colors of cyan, magenta, and yellow. When nozzle arrays of the respective colors have a narrow distance thereamong, a member constituting the part has an elongated shape. Thus, strengths of an ink container and a printing element substrate for a direction orthogonal to the nozzle arrangement direction are lower in this structure, and cause the ink container and the printing element substrate to easily deform, respectively.

SUMMARY OF THE INVENTION

In order to solve the above problems, the present invention has an objective of providing an ink jet print head having a simple structure and having high reliability, an ink jet head cartridge, an ink container, and a manufacture method of them.

The first aspect of the present invention is an ink jet head cartridge, comprising: an ink container for storing ink, said container having an elongated container-side ink supply opening and being formed by resin including filler material; and a printing element substrate that has a substrate-side ink supply opening, an ejection opening for ejecting ink, and an energy application element for applying energy to ink, wherein the printing element substrate is adhered to the ink container and ink stored in the ink container is transferred to the ejection opening via the container-side ink supply opening and the substrate-side ink supply opening to be ejected, and wherein the container-side ink supply opening of the ink container includes a beam member that crosses the container-side ink supply opening in a direction orthogonal to the longitudinal direction of the container-side ink supply opening and the beam member is shaped so that filler materials contained in the beam member are oriented in a direction along which the beam member extends.

The second aspect of the present invention is a print head, comprising: a substrate-side ink supply opening; an ejection opening for ejecting ink; and an energy application element for applying energy to ink, wherein the print head is adhered to an ink container for storing ink, said print head has an elongated container-side ink supply opening, said ink container is formed by resin including filler material, wherein ink stored in the ink container is sent to the ejection opening via the container-side ink supply opening and the substrate-side ink supply opening and is ejected, wherein the container-side ink supply opening includes a beam member that crosses the container-side ink supply opening in a direction orthogonal to the longitudinal direction of the container-side ink supply opening and the print head is adhered to the ink container that the beam member is shaped so that filler material included therein is oriented in a direction along which the beam member extends.

The third aspect of the present invention is an ink container, comprising: an elongated container-side ink supply opening; wherein the ink container is formed by resin including filler material to store ink, wherein the ink container is adhered with a printing element substrate that has a substrate-side ink supply opening, an ejection opening for ejecting ink, and an energy application element for applying energy to ink, wherein stored ink is sent to the ejection opening via the container-side ink supply opening and the substrate-side ink supply opening and is ejected through the ejection opening, wherein the container-side ink supply opening of the ink container includes a beam member crossing the container-side ink supply opening in a direction orthogonal to the longitudinal direction of the container-side ink supply opening and the beam member is shaped so that filler material included therein is oriented in a direction along which the beam member extends.

The fourth aspect of the present invention is a method for manufacturing an ink jet head cartridge, comprising: a step of flowing resin including filler material into a die; a step of performing die forming to form an ink container including a beam member crossing the longitudinal direction of an ink supply opening; a step of adhering a printing element substrate to the ink container, wherein: the step of flowing resin flows resin from a position dislocated in a direction orthogonal to the longitudinal direction of the ink supply opening from a position corresponding to a joint area in the ink container with the printing element substrate.

A beam member crossing an container-side ink supply openings is arranged in the ink supply openings in the side of ink storage to allow filler material included in resin constituting the ink container to be oriented in the beam member in a direction orthogonal to a longitudinal direction of the ink supply opening. This provides a smaller difference in the linear expansion coefficient between the ink container and a printing element substrate adhered to the ink container. This suppresses an amount of the deformation of the ink storage member and the printing element substrate due to the residual stress due to a temperature change at the joint area between the ink container and the printing element substrate.

Further features of the present invention will become apparent from the following description of exemplary embodiments with reference to the attached drawings.

DETAILED DESCRIPTION OF THE PREFERRED EMBODIMENTS

Embodiments of the present invention will be described with reference to the drawings.

FIGS. 5A and 5B to FIG. 8 illustrate a preferred print head for which the present invention is carried out. Hereinafter, the respective components will be described with reference to the drawings.

(1) Print Head

Figure 5A:
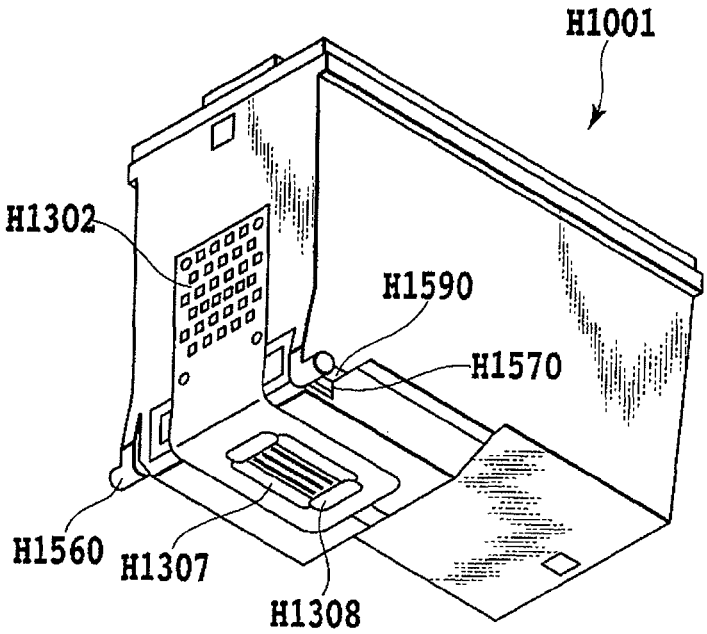
FIGS. 5A and 5B are an appearance perspective view showing the ink jet head cartridge according to the first embodiment of the present invention seen from the upper side and the lower side.
Figure 5B:
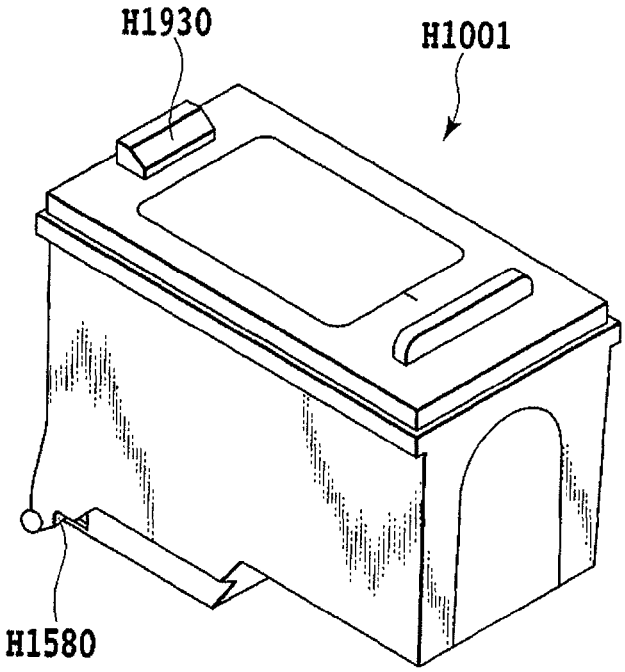

As shown in FIGS. 5A and 5B, the print head H1001 in this embodiment is a print head based on the ink jet printing method that uses an electrothermal conversion member for causing thermal energy for causing film boiling in ink in accordance with an electric signal. At the same time, the print head H1001 in this embodiment is a so-called side shooter-type print head structured so that an electrothermal conversion member is arranged so as to be opposed to an ink ejection opening. The print head H1001 of this embodiment is formed as an ink jet head cartridge in which a print head section is integrated with an ink container.

The print head H1001 is used to eject the respective three colors of ink of C, M, and Y. The print head H1001 is shown in the exploded perspective view of FIGS. 6A and 6B. The print head H1001 is composed of a printing element substrate H1101, an electric wiring tape H1301, an ink container H1501, a cover member H1901, and a seal member H1801. The ink container H1501 includes ink absorbers H1601, H1602, and H1603 via filters H1701, H1702, and H1703.

(2) Printing Element Substrate

Figure 7:
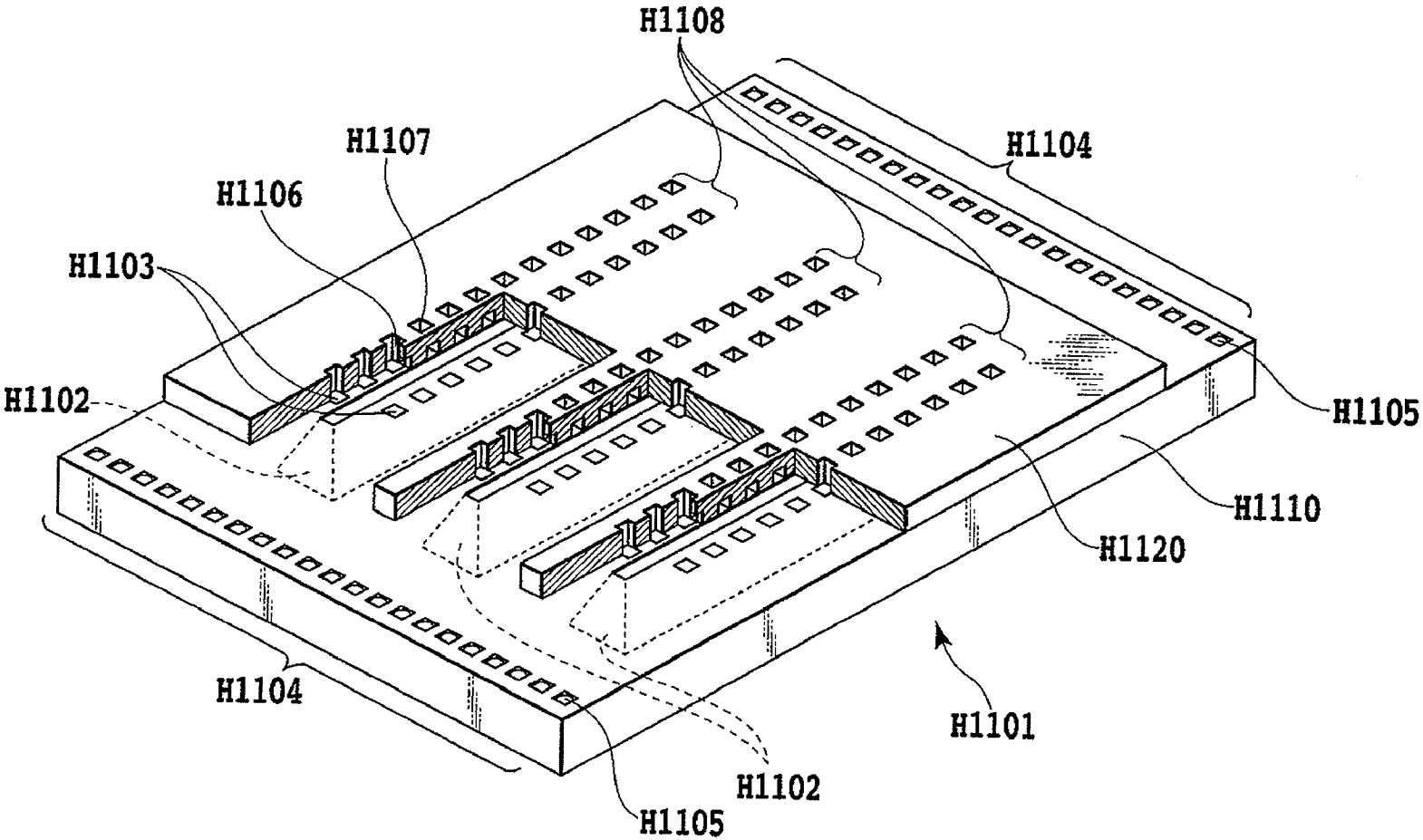
FIG. 7 is a perspective view illustrating the printing element substrate cut off partly, in the ink jet head cartridge of FIGS. 5A and 5B.

FIG. 7 is a perspective view illustrating the printing element substrate H1101 cut off partly for explaining the structure thereof in which three ink supply openings H1102 for cyan, magenta, and yellow are arranged in parallel with one another. The respective ink supply openings H1102 are sandwiched between two arrays of the electrothermal conversion elements H1103 as an energy application means for applying energy and are sandwiched between two arrays of the ejection openings H1107. The arrays of the electrothermal conversion elements H1103 and the ejection openings H1107 are arranged in a staggered manner. The printing element substrate H1101 is composed of an Si substrate H1110, an electric wiring, a fuse, and an electrode section H1104 or the like. The Si substrate H1110 is adhered with a ceiling section H1120 that is made of resin and that includes an ink flow path wall H1106 and an ejection opening H1107 formed by a photolithography technique. The Si substrate H1110 includes an electrode section H1104 for supplying power to an electric wiring. The electrode section H1104 includes a bump H1105 made of Au or the like.

(3) Electric Wiring Tape

The electric wiring tape H1301 is used to form an electric signal path transmits an electric signal to the printing element substrate H1101 for ejecting ink. The electric wiring tape H1301 includes an opening section for the assembly of the printing element substrate H1101. At an edge of this opening section, an electrode terminal H1304 is formed that is connected to the electrode section H1104 of the printing element substrate H1101. The electric wiring tape H1301 includes an external signal input terminal H1302 for receiving an electric signal from a main apparatus. The electrode terminal H1304 is connected to the external signal input terminal H1302 by a continuous wiring pattern of copper foil.

The electric wiring tape H1301 is electrically connected to the printing element substrate H1101. For example, the electric connection is achieved by using the ultrasonic thermal compression method to electrically joining the bump H1105 provided in the electrode section H1104 of the printing element substrate H1101 with the electrode terminal H1304 of the electric wiring tape H1301 corresponding to the electrode section H1104 of the printing element substrate H1101.

(4) Ink Container

The ink container H1501 is formed by molding resin. In order to improve the rigidity of the shape, resin material is desirably mixed with glass filler of 5 to 40%. Resin including filler material provides a characteristic according to which a linear expansion coefficient changes in accordance with the direction along which filler material is oriented.

Figure 6A:
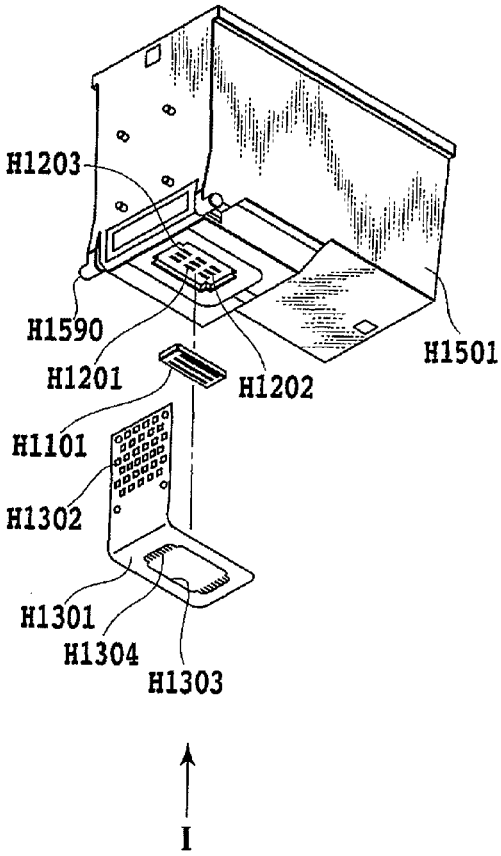
FIGS. 6A and 6B are exploded perspective views showing the ink jet head cartridge of FIGS. 5A and 5B seen from the upper side and the lower side.
Figure 6B:
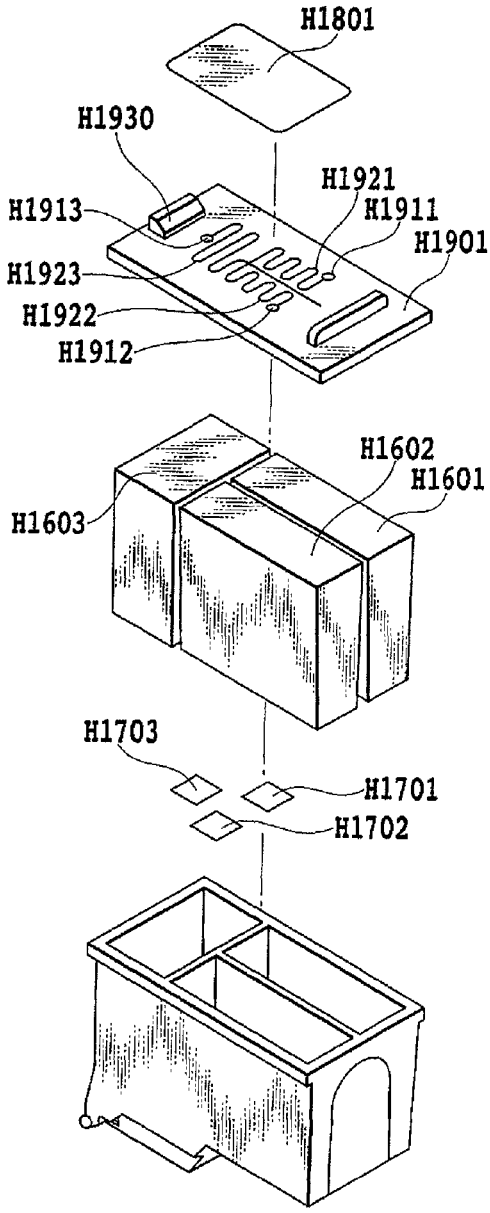

As shown in FIGS. 6A and 6B, the ink container H1501 includes a space for independently retaining ink absorbers H1601, H1602, and H1603 for generating a negative pressure for maintaining C, M, and Y ink and has a function as an ink container. The ink container H1501 include respective ink flow paths for guiding ink to respective ink supply openings H1102 of the printing element substrate H1101 to provide an ink supply function. Although the ink absorbers H1601, H1602, and H1603 are formed by compressed PP fibers, the ink absorbers H1601, H1602, and H1603 also may be formed by compressed urethane fibers. A boundary part with the ink absorbers H1601, H1602, and H1603 at the upstream of the respective ink flow paths of the ink container H1501 is welded with filters H1701, H1702, and H1703 for preventing dust from entering the printing element substrate H1101, respectively. The respective filters H1701, H1702, and H1703 may be a SUS metal mesh type but is more preferably a SUS metal fiber sintering type.

Figure 8:
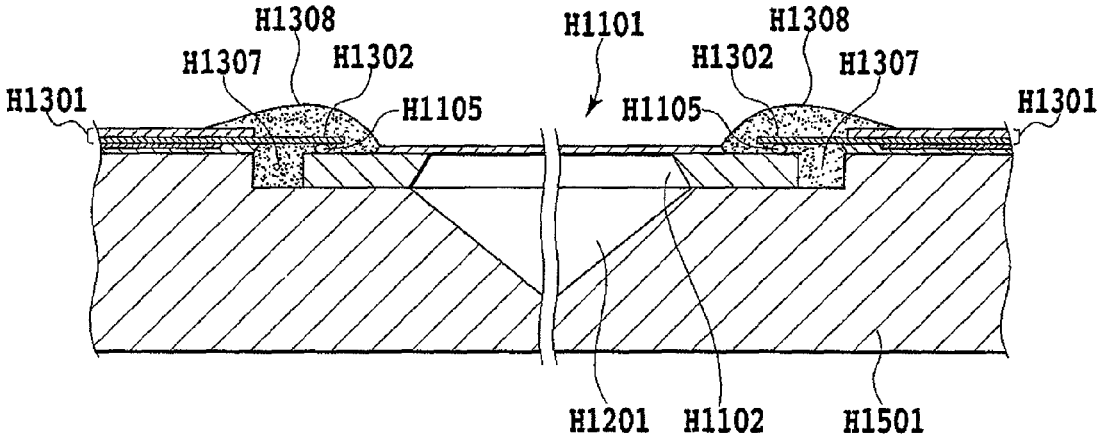
FIG. 8 is a cross sectional view illustrating the ink container and the printing element substrate of the ink jet head cartridge of FIGS. 5A and 5B.
Figure 9A:
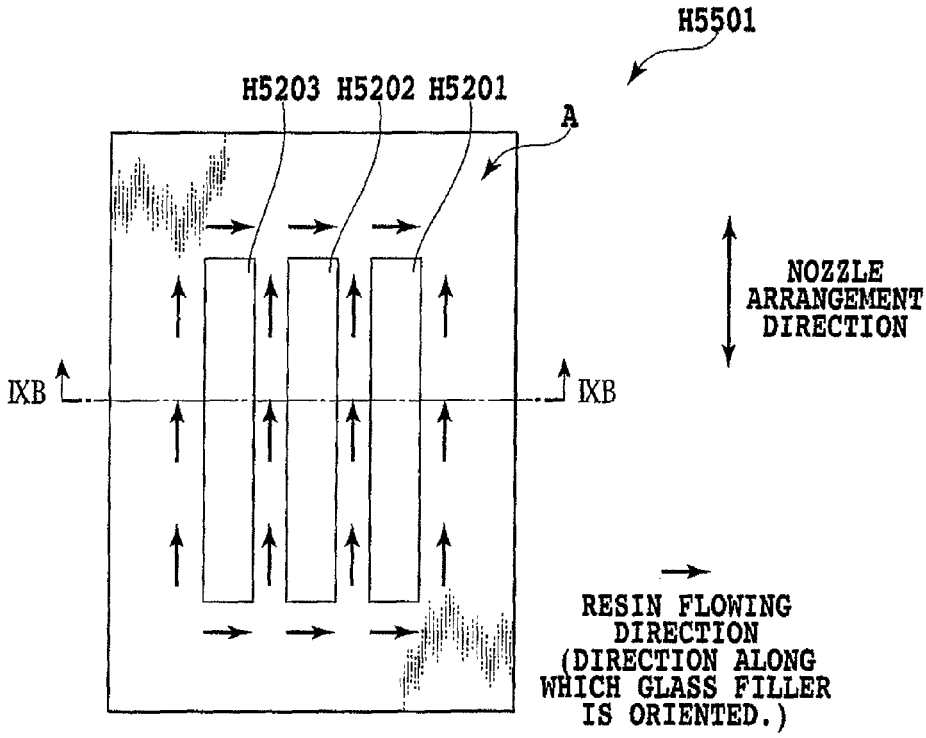
FIG. 9A is a schematic view illustrating an expanded view of the joint area between the conventional ink container and the printing element substrate and FIG. 9B is a cross sectional view taken along a line IXB-IXB.
Figure 9B:
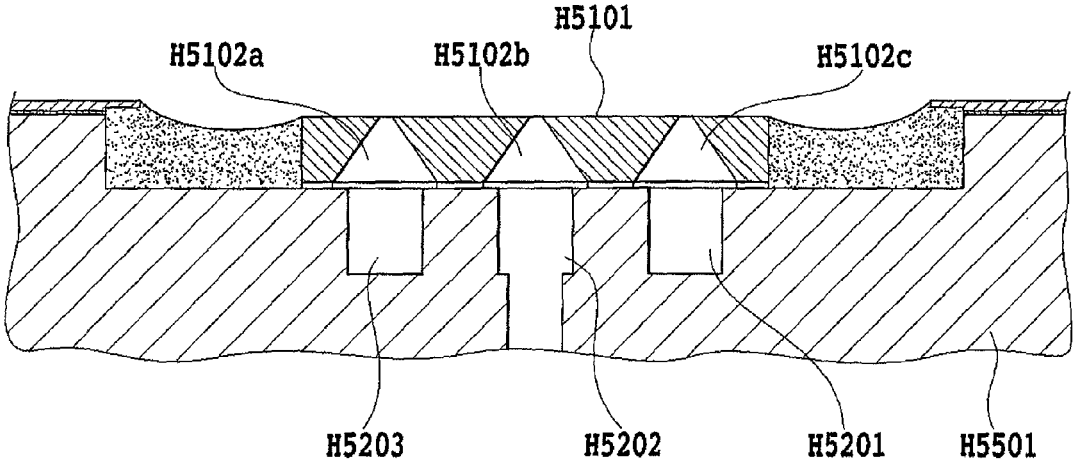

The downstream of the ink flow path has the ink supply openings H1201, H1202, and H1203 for supplying the respective cyan, magenta, and yellow inks to the printing element substrate H1101. In order to allow the respective ink supply openings 1102 of the printing element substrate H1101 to communicate with the respective ink supply openings H1201, H1202, and H1203 of the ink container H1501, the printing element substrate H1101 is adhered and fixed to the ink container H1501 with a high position accuracy. The ink container H1501 adhered with the printing element substrate H1101 is shown in FIG. 8. The first adhesive agent used for this adhesion desirably has low viscosity and a low curing temperature, cures within a short time, and has a relatively high hardness after curing and ink resistance. For example, the first adhesive agent is thermoset adhesive agent mainly including epoxy resin to desirably provide an adhesion layer having a thickness of about 50 μm.

A flat surface surrounding the ink supply openings H1201, H1202, and H1203 is adhered and fixed with the back face of a part of the electric wiring tape H1301 by the second adhesive agent. As shown in FIG. 8, a part at which the printing element substrate H1101 is connected to the electric wiring tape H1301 is sealed by the first sealant H1307 and the second sealant H1308 to protect the electric connection part from corrosion due to ink or an external shock. The first sealant H1307 mainly seals the back face of the connection part at which the electrode terminal H1302 of the electric wiring tape H1300 is connected to the bump H1105 of the printing element substrate and the outer periphery of the printing element substrate. The second sealant H1308 seals the top face of the above-described connection part. A not adhered part of the electric wiring tape H1301 is bent and is fixed, by heat caulking or adhesion for example, to a side face almost orthogonal to a surface having the ink supply openings H1201, H1202, and H1203 of the ink container H1501.

(5) Cover Member

A cover member H1901 is welded to an upper opening section of the ink container H1501 to seal the respective independent spaces in the ink container H1501. However, the cover member H1901 has narrow openings H1911, H1912, and H1913 for releasing pressure fluctuation in the respective rooms in the ink container H1501 and minute grooves H1921, H1922, and H1923 communicating thereto. The other end of the minute grooves H1921 and H1922 are merged with the middle part of the minute groove H1923. Most part of the narrow openings H1911, H1912, and H1913, the minute grooves H1921 and H1922, and the minute groove H1923 is covered by the seal member H1801. The other end of the minute groove H1923 has an opening to provide an air communication opening. The cover member H1901 also has an engagement section H1930 for fixing the print head to the ink jet printing apparatus.

First Embodiment

The following section will describe the first embodiment of the present invention in detail with reference to FIGS. 1A, 1B, 2A and 2B.

Figure 1A:
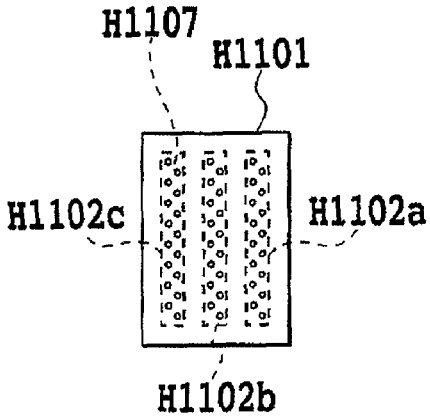
FIG. 1A is a schematic view illustrating an ink container and FIG. 1B is a printing element substrate seen from a printing face in the first embodiment of the present invention.
Figure 1B:
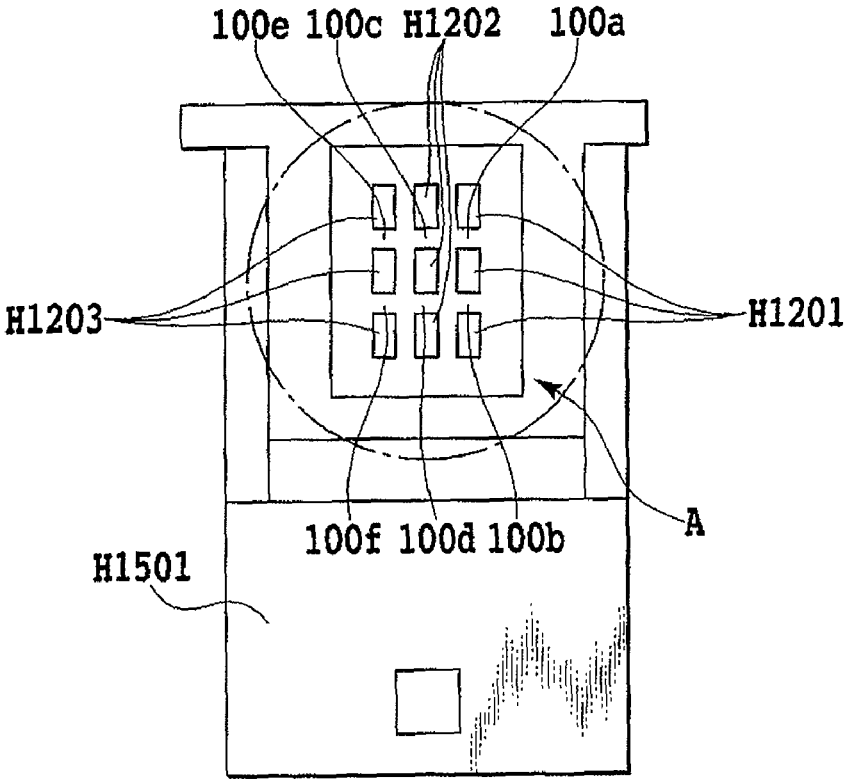
Figure 2A:
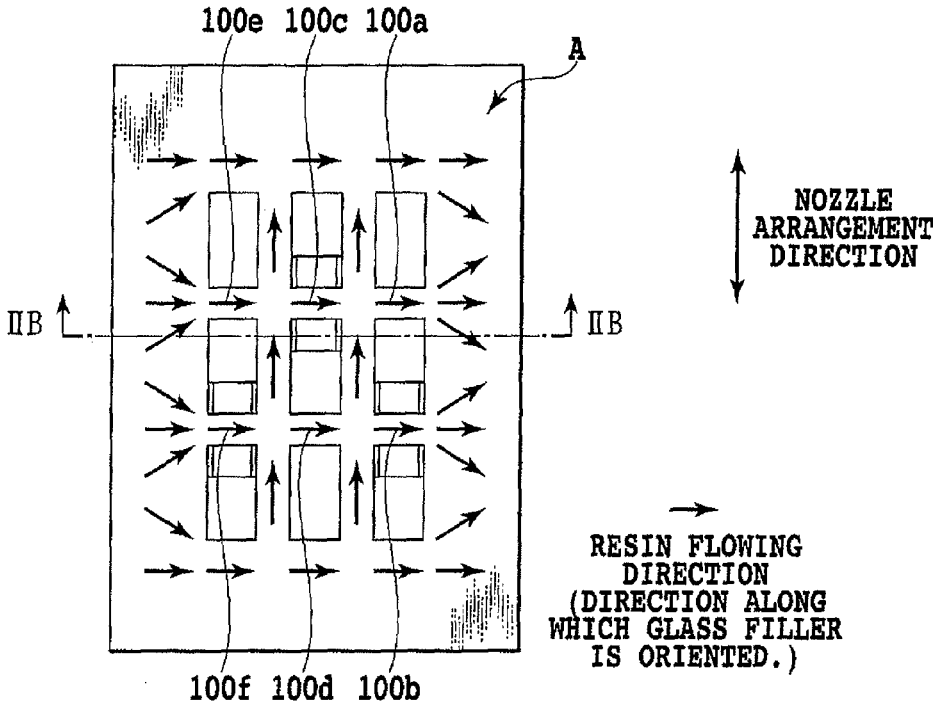
FIG. 2A is a schematic view showing an expanded view of the joint area A between the ink container and the printing element substrate and FIG. 2B is a cross sectional view taken along a line IIB-IIB.
Figure 2B:
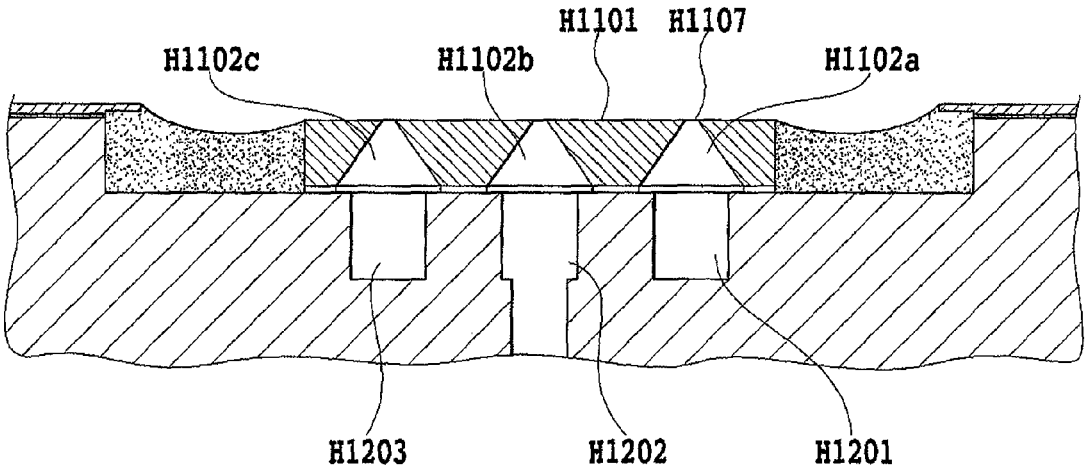

FIGS. 1A and 1B are a schematic view for explaining the first embodiment of the present invention. FIG. 1A shows the printing element substrate H1101 and FIG. 1B shows the ink container H1501. The ink container H1501 shown in FIG. 1B schematically show the ink container H1501 in FIG. 6A seen in the direction of an arrow I. The ink container H1501 has the joint area A as a region at which the printing element substrate H1101 shown in FIG. 1A is adhered. FIGS. 2A and 2B are a schematic expanded view of the periphery of the joint area A shown in FIG. 1B. The joint area A of the ink container H1501 includes the container-side ink supply openings H1201, H1202, and H1203 in three arrays to correspond to the three colors of C, M, and Y stored in the ink container H1501. Each of the container-side ink supply openings H1201, H1202, and H1203 for the respective colors includes two beam members 100. Thus, the beam members 100 divide the elongated container-side ink supply openings H1201, H1202, and H1203 to three ink supply openings in one array, respectively. As a result, container-side ink supply openings is divided to the total of nine container-side ink supply openings. The beam members 100 provided in the respective container-side ink supply openings H1201, H1202, and H1203 are composed, in this embodiment, of the total of six beam members 100*a*, 100*b*, 100*c*, 100*d*, 100*e*, and 100*f*. In this embodiment, the respective beam members 100 are provided in a direction orthogonal to the longitudinal direction of the container-side ink supply opening so as to cross the ink supply opening. The direction along which the container-side ink supply openings H1201, H1202, and H1203 extend is in the same direction as the nozzle arrangement direction.

FIGS. 1A and 1B show the ink container H1501 and the printing element substrate H1101. The printing element substrate H1101 includes the three substrate-side ink supply openings H1102*a*, H1102*b*, and H1102*c* corresponding to ink colors (C, M, and Y) that are formed in a face joined with the ink container H1501. The substrate-side ink supply openings H1102*a*, H1102*b*, and H1102*c* of the printing element substrate H1101 are positioned and adhered so as to communicate with the container-side ink supply openings H1201, H1202, and H1203 of the container H1501, thereby forming a print head.

When a printing operation is performed by a printing apparatus, ink is firstly supplied from the ink absorbers H1601, H1602, and H1603 in the ink container H1501 to the container-side ink supply openings H1201, H1202, and H1203 of the ink container H1501. Then, ink is stored in the substrate-side ink supply openings H1102*a*, H1102*b*, and 1102*c* formed in the printing element substrate H1101. As described above, ink is supplied from the ink container H1501 to the printing element substrate H1101. Then, a driving signal is applied to the electrothermal conversion element H1103 to give thermal energy. Then, the temperature of the electrothermal conversion element H1103 rapidly increases. As a result, thermal energy is given to ink and ink boils on the electrothermal conversion element H1103 to form bubbles. Bubbles in ink grow and shrink to send ink to the ejection opening H1107. Then, ink is ejected through the ejection opening H1107 to a printing medium placed under the ink container H1501.

Next, the following section will describe a relation between the ink container H1501 and the printing element substrate H1101 as well as the joint area with the printing element substrate H1101 in the ink container H1501.

After the ink container H1501 is adhered with the printing element substrate H1101, the container-side ink supply openings H1201, H1202, H1203 communicate with the substrate-side ink supply openings H1102*a*, H1102*b*, and H1102*c* for the respective colors.

The ink container H1501 is formed by resin including glass filler. The printing element substrate H1101 is formed by silicon.

The respective beam members 100 formed in the container-side ink supply openings H1201, H1202, and H1203 of the ink container H1501 have an elongated shape extending in a direction along which filler material included therein is oriented in a direction along which the beam member 100 extends. These beam members 100 in this embodiment are formed to have a width of 2 mm or less. Thus, when the beam member 100 is manufactured by molding, resin flows in the direction along which the beam member 100 extends. As a result, glass filler existing in the beam member 100 after the molding is distributed in the same direction as the direction along which the beam member 100 extends. In this embodiment, resin flows in the direction shown by the arrows in FIG. 2A. In the beam members 100 among the container-side ink supply openings H1201, H1202, and H1203, glass filler is oriented in a direction orthogonal to the nozzle arrangement direction.

Resin has a smaller linear expansion coefficient in the direction along which glass filler included therein flows than that in a direction orthogonal to the flowing direction. Thus, in the beam member 100, a difference in the linear expansion coefficient between the printing element substrate H1101 and the container H1501 is smaller. When the difference in the linear expansion coefficient is smaller and even when the printing element substrate H1101 and the container H1501 are subjected to a temperature change, a difference in the expansion amount between these materials at the joint area A is smaller. This can suppress the residual stress caused by a temperature change in the direction orthogonal to the nozzle arrangement direction in the joint area A to suppress the deformation of the ink container H1501. In addition, an improved strength is obtained in a direction orthogonal to the nozzle arrangement direction of the ink container H1501. This further suppresses the deformation of the ink container H1501. As a result, a reliable ink jet print head can be provided.

Resin used for the ink container in this embodiment is PCN2910 (modified PPO) made by Nihon GE Plastics Ltd. including glass filler of 30%. According to the specification catalog, the resin has a linear expansion coefficient in a resin flowing direction of 21×10E-6 and a linear expansion coefficient in a direction orthogonal to the flowing direction of 33×10E-6.

At the joint area A, silicon has the linear expansion coefficient of 3×10E-6. On the other hand, resin in the conventional printing element substrate flows in the nozzle arrangement direction in the area. Thus, the linear expansion coefficient of resin is 33×10E-6 in the area. This means that the ink container formed by resin has a linear expansion coefficient at the joint area that is about 10 times higher than that of the printing element substrate formed by silicon.

An object has a linear expansion coefficient α that is represented by the following formula.

$$\alpha=\Delta L/(\Delta T \cdot L_o)[1/\text{deg C.}]$$

α: Linear expansion coefficient

ΔL: Elongation of the object due to heating

ΔT: Temperature difference of the object before and after heating $L_o$: Length of the object before heating Glass filler exists in the beam member 100 in a direction orthogonal to the nozzle arrangement direction in this embodiment. Thus, while silicon has a linear expansion coefficient of 3×10E-6, the material of resin in this embodiment has a linear expansion coefficient of 21×10E-6 in a direction along which the beam member 100 extends.

Thus, the beam member 100 suppress the difference in the linear expansion coefficient in the joint area between an ink container and a printing element substrate. This can suppress the generation of stress at the joint area due to a temperature change and also can suppress the deformation of the product.

Here, the beam member 100 formed in the container-side ink supply openings H1201, H1202, and H1203 desirably has a minimized width to obtain amore apparent effect. Glass filler in resin is oriented in a direction of the flow of resin during the molding. The narrower width the beam member 100 has the more resin flows in the direction along which the beam member 100 extends and the filler in resin is oriented along the flow of resin. If the beam member 100 is formed to have a wide width, a possibility is caused where the filler may be dispersed in the beam member 100 to cause unstable orientation of the filler to fail to control the orientation. Thus, the beam member 100 having a wide width requires a correct design of a gate position in order to stabilize the filler orientation, thus making the manufacture difficult. The filler itself has a width of about ϕ10 micron×300 micron. The result of an experiment shows that the beam members 100 among the container-side ink supply openings H1201, H1202, and H1203 desirably have a width of about 2 mm or less. The reason is that the width equal to or higher than about 2 mm cause unstable filler orientation and make reduced effect of the existence of the beam members 100.

The beam member 100 preferably has a shape obtained by rounding or tapering a corner of a container-side ink supply opening in order to allow glass filler to flow along the shape of the beam. By shaping the corner of the container-side ink supply opening in this manner, resin can flow so that filler in the beam member 100 can be oriented in a fixed direction.

A more preferred method for reducing the residual stress at the joint area A due to a temperature change in the periphery is to increase number of the beam members 100 among the container-side ink supply openings. The more the beam members 100 are provided, the more area has a small difference in the linear expansion coefficient among materials jointed. Thus, more residual stress due to a temperature change in the periphery can be suppressed at the joint area. Therefore, the maximum number of the beam members 100 is desirably provided so long as insufficient ink supply can be prevented that is due to the decrease in the area of the opening of the container-side ink supply openings H1201, H1202, and H1203.

Second Embodiment

Figure 3A:
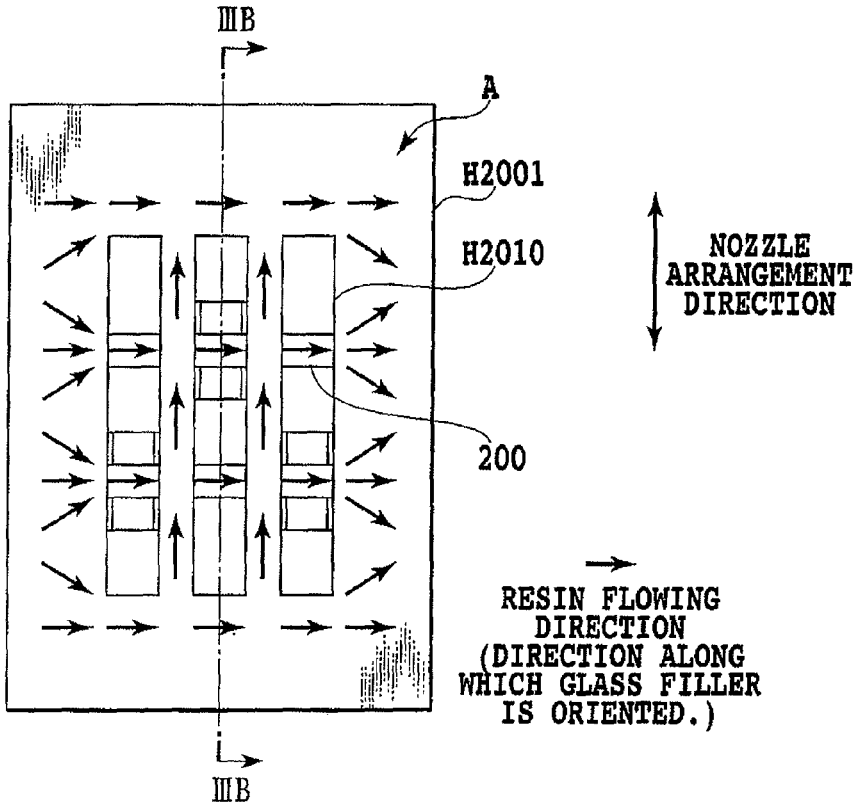
FIG. 3A is a schematic view showing an expanded view of the joint area A between the ink container and the printing element substrate in the second embodiment and FIG. 3B is a cross sectional view taken along a line IIIB-IIIB.
Figure 3B:
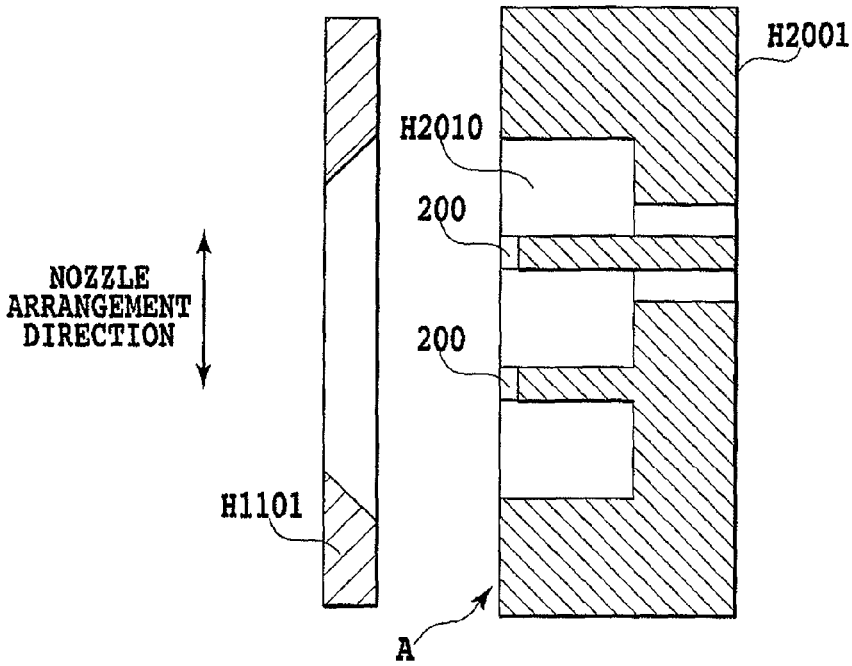

Next, the second embodiment of the present invention will be described with reference to FIGS. 3A and 3B.

In the first embodiment, a height of the beam member 100 formed at the container-side ink supply opening H1201, H1202, and H1203 from the bottom faces of the container-side ink supply openings H1201, H1202, and H1203 is identical as that of the other surfaces at the joint area in ink container H1501. However, in the second embodiment, the surface of the beam member is retracted from the surface of joint area at the ink container. The ink container H2001 having the structure as described above is shown in FIG. 3. By retracting the beam member 200 from the surface of joint area, the printing element substrate H1101 can be adhered to allow adhesive agent extruding from the joint area to be stored in a space between the retracted beam member 200 and the printing element substrate H1101. This can prevent adhesive agent extruding from the joint area from entering the container-side ink supply opening H2010. In this case, glass filler in the beam member 200 is oriented in a direction orthogonal to the nozzle arrangement direction as described for the first embodiment. Thus, the same effect as that of the first embodiment can be obtained.

Third Embodiment

Next, the third embodiment of the present invention will be described with reference to FIG. 4.

Figure 4:
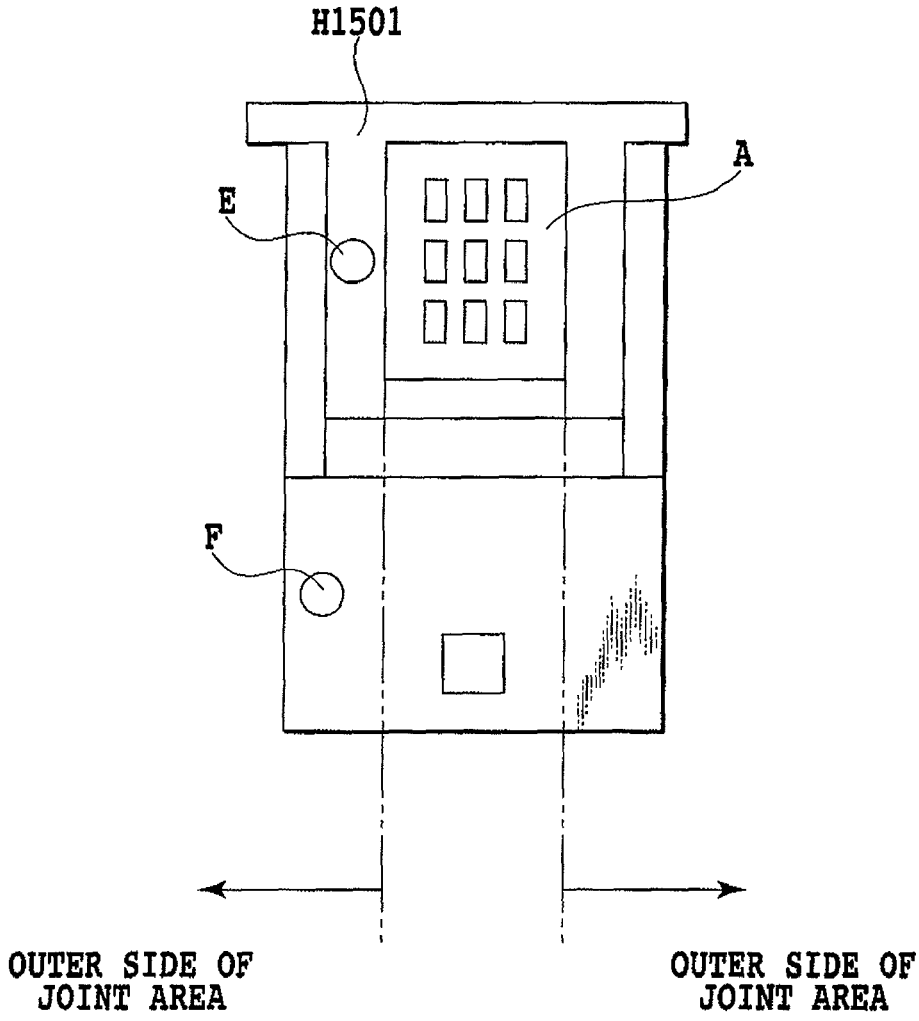
FIG. 4 is a schematic view illustrating the joint area A between the ink container and the printing element substrate in the third embodiment and a position of a gate through which resin is injected to a forming die to form the ink container.

FIG. 4 is a schematic view illustrating a positional relation between the joint area A in the ink container H1501 adhered with the printing element substrate H1101 and a gate as an opening through which resin is injected into a forming die to manufacture an ink container by die forming. A position on the ink container H1501 corresponding to the gate position of this embodiment is shown by E of FIG. 4.

As described in the first embodiment, glass filler at the joint area A of the ink container H1501 is advantageously oriented in a direction orthogonal to the nozzle arrangement direction for the purpose of reducing the difference in the linear expansion coefficient between the ink container H1501 and the printing element substrate H1101. Thus, when considering the direction along which resin flows during the molding, the gate is desirably provided at a position of the forming die that is dislocated in a direction orthogonal to the nozzle arrangement direction from the joint area A between the ink container and the printing element substrate and that has a maximum distance from the joint area A. The gate positioned at such a position allows, when resin is injected to the forming die, even parts other than the beam member 100 in the ink container H1501 to have glass filler included in resin that is easily oriented in a direction orthogonal to the nozzle arrangement direction. Thus, even the outside of the container-side ink supply opening H1201, H1202, H1203 at the joint area A between the ink container H1501 and the printing element substrate H1101 can have more glass filler included in resin that is oriented in a direction orthogonal to the arrangement direction. As a result, even the outside of the container-side ink supply opening H1201, H1202, H1203 at the joint area A can have a smaller difference in the linear expansion coefficient between the materials to suppress the generation of stress at the joint area A caused due to a temperature change in the periphery. This is clear also from the result of the flow analysis. When actual molded articles one of which has a gate positioned at the center and the other of which has a gate positioned at an outer side as in this embodiment are compared, these articles show different directions along which glass filler is oriented in the joint area A.

In order to confirm the effect of the present invention, illustrative examples 1 to 5 according to the present invention were compared with comparison example 1 where resin does not include filler and comparison example 2 where no beam member is provided. Samples were prepared to have a nozzle having a length of 1 inch/600 dpi in consideration of a trend where a length of nozzle arrangement is increased and more nozzles are arranged with a higher density. In this experiment, the respective samples were subjected to a temperature cycle test of −30 deg C. and 60 deg C. to perform printing to measure an ink landing accuracy. The illustrative examples of the present invention and comparison examples were subjected to the experiment while having "beam member width", "filler", and "gate position" of Table 1 shown below. The resultant ink containers were used to perform printing, the result of ink landing accuracies in the print were shown in "print quality" of Table 1. However, the "beam member width" means a width of the beam member 100 formed in the container-side ink supply opening H1201, H1202, H1203 in a nozzle arrangement direction. The "filler" shows a ratio of bar-like glass filler occupying resin material. The "gate position" means a position on an ink container corresponding to the position of an opening through which resin is injected into a forming die for the manufacture of an ink container. The characters E and F means the position E and the position F in FIG. 4, respectively. The "print quality" as an experiment result is determined based on criteria according to which an ink landing accuracy of 20 μm or less for printing a line is represented by ○, an ink landing accuracy of 30μ or less is represented by Δ, and an ink landing accuracy of 30 μm or more is represented by x. Based on the criteria, the illustrative examples and comparison examples were evaluated.

TABLE 1

| | Beam member width | Filler | Gate position | Print quality |
|---|---|---|---|---|
| Illustrative example 1 | 1 mm | 30% | E | ○ |
| Illustrative example 2 | 2 mm | 30% | E | ○ |
| Illustrative example 3 | 2 mm | 30% | F | ○ |
| Illustrative example 4 | 3 mm | 30% | E | ○ |
| Illustrative example 5 | 3 mm | 30% | F | Δ |
| Comparison example 1 | 2 mm | No | E | x |
| Comparison example 2 | No | 30% | E | x |

As shown above, a poor ink landing accuracy was caused when the resin constituting the ink container H1501 did not include glass filler or when the beam member 100 was not provided. When the illustrative examples 4 and 5 are compared to each other where the beam member 100 is similarly formed but the gate positions in the ink container H1501 are different, the illustrative example 4 having the gate position E shows a superior ink landing accuracy than that of the illustrative example 5 having the gate position F. When the illustrative examples 3 and 5 are compared to each other where the widths of the beam members 100 are different, the illustrative example 3 having the beam member 100 having a width of 2 mm shows a superior ink landing accuracy than that of the illustrative example 5 having the beam member 100 having a width of 3 mm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-329736, filed Dec. 6, 2006, which is hereby incorporated by reference herein in its entirety.

What is claimed is:

1. An ink jet print head, comprising:

a printing element substrate including a first ink supply opening being elongated in a longitudinal direction and supplying ink to an ejection port and to an energy application element for applying energy to ink; and a joint member including a joint area jointed with the printing element substrate, wherein the joint member includes a second ink supply opening being a through hole which communicates with the first ink supply opening at the joint area, a plurality of the second ink supply openings being formed along the longitudinal direction of the first ink supply opening, and a beam member formed, by flowing a resin including a filler material along a crossing direction crossing the longitudinal direction of the first ink supply opening, at a position between the plurality of the second ink supply openings.

2. The ink jet print head according to claim 1, wherein:

the beam member has a width along the longitudinal direction of the first ink supply opening of 2 mm or less.

3. The ink jet print head according to claim 1, wherein:

the beam member is retracted from the joint area.

4. The ink jet print head according to claim 1, wherein:

the filler material included in the beam member is oriented along the crossing direction.

5. The ink jet print head according to claim 1, wherein:

a portion jointed with the joint area of the printing element substrate is formed by silicon.

6. The ink jet print head according to claim 1, wherein:

the joint member is formed by resin including filler material, an opening used for injecting resin into a die during forming of the joint member is set at a position offset from a portion jointed with the printing element substrate to the crossing direction, in the joint area.

7. A method for manufacturing the ink jet print head according to claim 1, wherein:

the joint member is formed by resin including filler material, the method comprises a step of flowing resin into a die, and resin is flowed from a position corresponding to a position offset from a portion jointed with the printing element substrate to the crossing direction, in the joint area, during forming of the joint member.

8. The ink jet print head according to claim 1, wherein the energy application element is arranged on the printing element substrate at the ejection port, and further comprising a ceiling section including the ejection port and an ink flow path wall for flow of ink from the first ink supply opening to the ejection port.

9. An ink container, comprising:

a joint member jointed with a printing element substrate, wherein the printing element substrate includes a first ink supply opening being elongated in a longitudinal direction and supplies ink to an ejection port and to an energy application element for applying energy to ink;

wherein the joint member defines a second ink supply opening being a through hole which communicates with the first ink supply opening at a joint area therebetween, a plurality of the second ink supply openings being formed along the longitudinal direction of the first ink supply opening;

an ink containing portion storing ink therein which communicates with the second ink supply opening; and a beam member formed, by flowing a resin including a filler material along a crossing direction crossing the longitudinal direction of the first ink supply opening, at a position between the plurality of the second ink supply openings.

10. An ink container according to claim 9, wherein the energy application element is arranged on the printing element substrate at the ejection port, and further comprising a ceiling section including the ejection port and an ink flow path wall for flow of ink from the first ink supply opening to the ejection port.

* * * * *